United States Patent [19]

Koehn

[11] Patent Number: 5,012,940

[45] Date of Patent: May 7, 1991

[54] CLOSURE WITH ORIGINALITY GUARANTEE

[75] Inventor: Jochen Koehn, Bergwinkel, Fed. Rep. of Germany

[73] Assignee: Zeller Plastik GmbH, Zell, Fed. Rep. of Germany

[21] Appl. No.: 217,595

[22] Filed: Jul. 7, 1988

[30] Foreign Application Priority Data

Jul. 7, 1987 [DE] Fed. Rep. of Germany ..... 3722330

[51] Int. Cl.[5] ..... B65D 41/32

[52] U.S. Cl. ..... 215/230; 215/253

[58] Field of Search ..... 215/230, 232, 253, 365, 215/250; 206/459

[56] References Cited

U.S. PATENT DOCUMENTS

| | | | |
|---|---|---|---|
| 1,920,396 | 8/1933 | Johnson | 215/230 X |
| 2,055,693 | 9/1936 | Lewin | 215/230 X |
| 2,213,932 | 9/1940 | Rehfeld | 215/365 |
| 3,088,830 | 5/1963 | Graham | 215/253 X |
| 3,244,306 | 4/1966 | Stolk | 215/232 X |
| 3,516,852 | 6/1970 | Janssen . | |
| 4,487,324 | 12/1984 | Ostrowsky | 215/253 |
| 4,702,383 | 10/1987 | Wender | 215/230 X |

FOREIGN PATENT DOCUMENTS

| | | |
|---|---|---|
| 403911 | 10/1924 | Fed. Rep. of Germany . |
| 909427 | 7/1953 | Fed. Rep. of Germany . |
| 1888910 | 3/1964 | Fed. Rep. of Germany . |
| 1209866 | 1/1966 | Fed. Rep. of Germany . |
| 2113781 | 3/1971 | Fed. Rep. of Germany . |
| 2931853 | 8/1979 | Fed. Rep. of Germany . |
| 8319574 | 11/1983 | Fed. Rep. of Germany . |

*Primary Examiner*—Donald F. Norton

*Attorney, Agent, or Firm*—Nixon & Vanderhye

[57] ABSTRACT

An originality guarantee for closures of containers, particularly bottles. It has a label (12) which, after it has been removed or damaged, indicates that the closure has been opened. The closure portions (4,6) which are to be moved apart when it is opened are provided with flat recesses for receiving the label (12). The recesses merge from one closure portion into the other or others and together have the external shape and size of the label. Such a label indicates that the closure has been opened when it is torn or cut through. The invention also prevents the possibility of the label being removed and glued on again. This purpose can be served by the said recess which makes it impossible for a user to engage beneath the label with a finger nail or a tool and to lift it away. Instead of a recess a horseshoe-shaped wall (22) can be provided which surrounds at least a portion of the label. It may be broken away so that the user has access to the label. The fact that the wall has been broken away and thus that the container has been opened is indicated by remaining upstanding portions of the material. The label may also be provided with an adhesive which only permits a single adhesion step and thus makes it impossible to reapply a removed label after tampering with the contents.

15 Claims, 1 Drawing Sheet

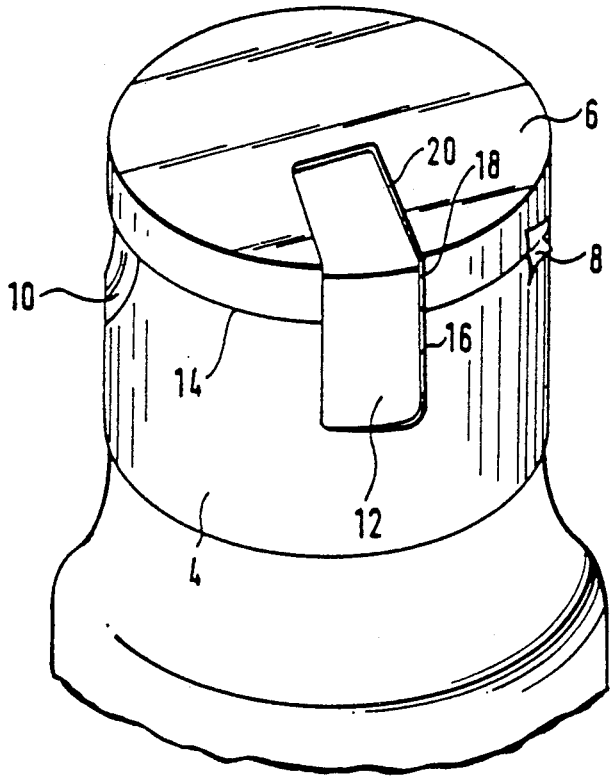
Fig. 1
Fig. 4
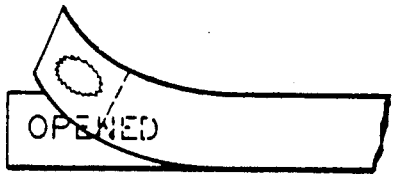
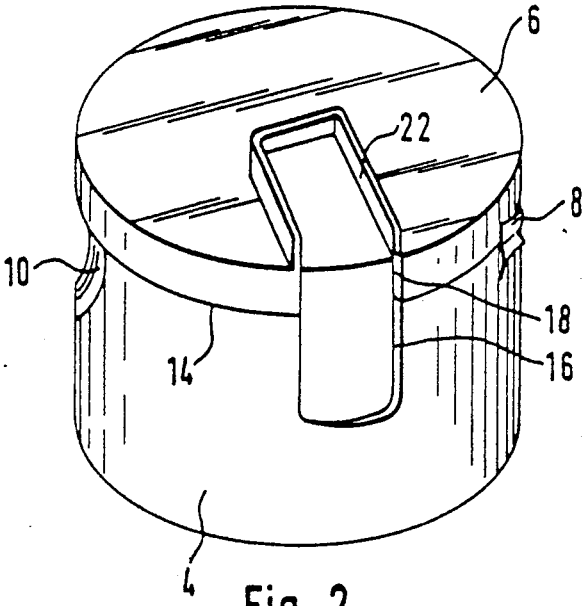
Fig. 2
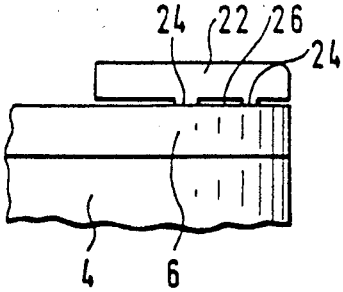
Fig. 3

CLOSURE WITH ORIGINALITY GUARANTEE

The invention relates to an originality guarantee (a tamper indicator) with a label. The label is supposed to, as usual, hold the portions of the closure closed. In general there are two closure portions, namely a lower portion and a lid. However, more closure portions can also be held together by the same label, e.g. additionally an intermediate ring also. So long as the label is situated in position this means that the closure has not been opened after having been originally filled. Known originality guarantees do however not provide sufficient assurance. The object of the present invention is to provide an originality guarantee which ensures a very high degree of security against falsification.

The invention will be firstly described in a few exemplary embodiments with reference to the accompanying drawings of which:

FIG. 1 is a perspective view of a closure for the mouth of a container, particularly a bottle, with a label sitting in recesses;

FIG. 2 shows a closure in which the label is in part surrounded by a wall and is also accommodated in recesses;

FIG. 3 shows a detail of the closure of FIG. 2; and

FIG. 4 shows multi-part label alternative embodiments.

The closure of FIG. 1 has a lower portion 4, a hinged lid 6 and a snap hinge 8. The lower portion has an engagement depression 10.

A label 12 connects the lid 6 and lower portion 4 of the closed closure.

If the label is torn or cut through in the junction plane 14 between the lid 6 and lower portion 4, this indicates that the closure has been opened. One must however prevent the label from being removed after opening (tampering with the content of the container) and gluing it on again upon reclosing the container. This purpose is served by a number of features which can each be used alone. However, a number of them are preferably used together.

In the preferred embodiment, flat recesses are present on the closure members which together have the external shape and size of the label as precisely as possible and into which the label 12 as shown here is glued. The recesses have narrow edge surfaces 16,18,20 which prevent someone from engaging beneath the label with a finger nail or tool and being able to lift it up. The edge surfaces preferably meet the adjacent surface areas of the closure portions at sharp edges, particularly at right-angles.

In order to enable the user to remove the label without damaging it, (e.g. because it has a value for collection or reminder purposes), an approximately horseshoe-shaped wall 22 can be provided as shown in FIGS. 2 and 3, instead of a flat recess. This wall 22 may be provided at at least one end of the label on the one closure portion and may be injection moulded on the lid. In the preferred embodiment, wall 22 may be broken away by the user. After breaking away the wall the user has access to edges which are now exposed of the label 12 and can remove the label without destroying it.

As shown in FIG. 3, the wall can be connected to the lid by only a few bridges 24 but otherwise separated from the lid by thin slits 26 so that a predetermined breaking line is produced. After breaking away the wall, remnants of the bridges 24 are present and indicate that the container has been opened even if the label which was then removed has been replaced by another label.

For additional security the label 12 can be applied with an adhesive which only permits a single adhesion process. A subsequent adhesion with the aid of the original adhesive is thus not possible. With a suitable choice of materials a subsequent adhesion is also not possible with the use of another adhesive.

The label can have two layers and (see FIG. 4), in particular can, consist of only two layers—an inner layer directed towards the closure portions and an outer layer. The inner layer is permanently sealed on or secured by adhesive. The outer layer is connected to the inner layer by a releasable adhesive which is also capable of only a single adhesion step. It is noticeable if the outer layer is removed. For the purposes of clarity the inner layer can carry an imprint such as "container open".

The outer layer can comprise individual flat portions, in the manner of badges for German vehicle number plates which tear apart on removal (see FIG. 4).

The outer layer can carry a forgery-proof imprint in the manner of paper currency so that forging labels is too expensive or it is easily noticeable if forged labels have been applied (see FIG. 4).

I claim:

1. An arrangement for indicating whether a closed container has been opened, said container being of the type for receiving a multi-part closure and having a label adhered in part to a first portion of the closure and in part to a second portion of said closure, said label having a certain size and shape, said arrangement comprising:

means disposed on said first portion for defining a first flat recess for receiving the label, and means disposed on said second portion for defining a further flat recess for receiving said label, said first and second recesses being in registry with one another when said container receives said closure and together defining a composite recess having said certain shape and size of said label.

2. Originality guarantee arrangement as in claim 1 wherein the label includes permanent adhesive means for adhering said label and for causing destruction of said label if said label is removed from said closure portions.

3. Originality guarantee arrangement as claimed in claim 1 wherein:

the label includes separable inner and outer layers, the inner layer is permanently disposed within the recesses, and the outer layer is adhered to the inner layer by a releasable adhesive.

4. Originality guarantee arrangement as claimed in claim 3, wherein the inner layer includes imprint means for indicating whether the container has been opened.

5. Originality guarantee arrangement as claimed in claim 3 or 4, wherein the label outer layer includes means for defining a forgery-proof imprint.

6. Originality guarantee arrangement as claimed in claim 1 wherein the label has an outer layer, and at least said label outer layer comprises individual surface portions which tear apart upon removal.

7. Originality guarantee arrangement for sealing a container of the type having a label, said label indicating that the container has been opened whenever the label is removed or damaged, said arrangement comprising:

a first closure portion for the mouth of said container;

a second closure portion engageable with said first closure portion, the first and second closure portions capable of being moved apart when said container is opened and are together provided with an adhesive label and thereby held in engagement by said label;

at least one of said first and second closure portions having a surface including projecting means projecting from said surface and breakable by the user to provide access to the label.

8. Originality guarantee arrangement as claimed in claim 7, further including:

a wall disposed on at least one of said first and second closure portions surrounding only a portion of said label; and a set of recesses provided for portions of the label which are not surrounded by a wall, which further set of recesses have the common external shape and size of the portion of the label not surrounded by said wall.

9. Originality guarantee arrangement as claimed in claim 1 or 8, wherein the recesses have bottom surfaces and are bordered by edge surfaces which meet the adjacent surface areas of the first and second closure portions and the bottom surfaces of the recesses at right angled sharp edges.

10. Originality guarantee arrangement as claimed in claim 7, wherein said projecting means is connected to said one of said closure first and second portions at a predetermined breaking line.

11. Originality guarantee arrangement as claimed in claim 10, wherein said projecting means is connected to the one closure portion by plural frangible bridges.

12. An arrangement for closing a container comprising:

first closure member means associated with said container and defining a first recess terminating in a first open end;

second closure member means for coupling to said first closure member means and for thereby sealing an opening in the first closure member and defining a further recess terminating in a further open end, said first and further open ends being in registry with one another when said second closure member means seals said opening; and an adhesive label adhered to said first and second closure member means and disposed within said first and further channels.

13. An arrangement as in claim 12 wherein:

said second closure member means includes breakable wall portion means surrounding said further recess, said wall portion means for being broken away from said second closure member means and for thereby permitting said label to be removed.

14. An arrangement as in claim 12 wherein said label includes a first portion permanently adhered to said closure member means and a second portion easily removably adhered to said first label portion.

15. An arrangement for sealing a container neck, said arrangement of the type including an adhesive label for indicating if said container neck has been unsealed, said arrangement including:

first closure member means associated with said container neck, said first closure member means for defining a first recess means terminating in a first open end; and second closure member means for sealingly engaging with said first closure member means, said second closure member means also for defining a further recess means terminating in a further open end, said first and further open ends being in registry with one another when said first and second closure member means are sealingly engaged, said registered first and further recess means together retaining said adhesive label therewithin.

* * * * *